US005788156A

United States Patent [19]

Dopp et al.

[11] Patent Number: 5,788,156

[45] Date of Patent: Aug. 4, 1998

[54] SEGMENT ROTARY NOZZLE

[75] Inventors: Siegfried Dopp; Georg Busch, both of Hamburg, Germany

[73] Assignee: Mantis VLV-Spruhgerate GmbH, Hamburg, Germany

[21] Appl. No.: 596,150

[22] PCT Filed: Jul. 29, 1994

[86] PCT No.: PCT/EP94/02529

§ 371 Date: Feb. 16, 1996

§ 102(e) Date: Feb. 16, 1996

[87] PCT Pub. No.: WO95/03893

PCT Pub. Date: Feb. 9, 1995

[30] Foreign Application Priority Data

Aug. 3, 1993 [DE] Germany ..... 43 26 714.9

[51] Int. Cl.[6] ..... B05B 1/28; B05B 3/02

[52] U.S. Cl. ..... 239/122; 239/127; 239/215; 239/222

[58] Field of Search ..... 239/215–217, 239/222, 122, 124, 127

[56] References Cited

U.S. PATENT DOCUMENTS

| | | | |
|---|---|---|---|
| 2,063,048 | 12/1936 | Norris | 239/217 |
| 2,545,489 | 3/1951 | Norris | 239/217 |
| 2,749,179 | 6/1956 | Almquist | 239/215 |
| 2,967,667 | 1/1961 | Norris | 239/217 X |
| 2,967,668 | 1/1961 | Norris | 239/217 X |
| 3,267,701 | 8/1966 | Mandarino | 239/215 X |
| 4,553,700 | 11/1985 | Snyder et al. | 239/215 |
| 4,616,783 | 10/1986 | Weber et al. | 239/216 |

FOREIGN PATENT DOCUMENTS

| | | |
|---|---|---|
| 2526330 | 5/1983 | France . |
| 2554017 | 5/1985 | France . |
| 2164270 | 3/1986 | United Kingdom . |
| 8603991 | 7/1986 | WIPO . |

*Primary Examiner*—Lesley D. Morris
*Attorney, Agent, or Firm*—Michael J. Striker

[57] ABSTRACT

A device for spraying a liquid has a rotating surface, preferably one with an edge apron which is angled obliquely toward the outside, from whose possibly serrated outer spraying edge the liquid is flung out. The rotating surface is partially covered by a housing which is provided with an opening which leaves a partial circumference free. The device has a reservoir and a flow path for collecting retained drops, in whose circulation a pump is provided which is embodied to reunite collected liquid with the inflowing liquid. A conveying surface of a pump, preferably a friction pump, is disposed coaxially with the axis of rotation of the rotating surface.

5 Claims, 5 Drawing Sheets

SEGMENT ROTARY NOZZLE

BACKGROUND OF THE INVENTION

The invention relates to a device for spraying a liquid, wherein a rotating surface is embodied to be partially enclosed by a housing with an opening leaving a partial circumference free, and the device for collecting retained drops has a reservoir and a flow path in whose circulation a pump is provided which is embodied to combine collected liquid with the inflowing liquid.

In previously known devices of this type the drops are flung away on all sides perpendicularly with their axis of rotation by a centrifugal disk. Under the influence of gravity the drops form a so-called spray cone, whose diameter can be affected by the rpm of the centrifugal disk. To achieve a sufficiently fine and even drop size it is necessary to drive the centrifugal disk at high rpm of 10,000 to 15,000 revolutions per minute, for example. Although in the process it is possible to achieve a very even drop size of 35 μ, for example, the hollow cone created in the course of spraying has a relatively large diameter of, for example, 100 to 120 cm, which is undesirable for many purposes.

Such devices are used in agriculture for covering areas with herbicides. In order to be able to treat the areas between the rows of useful plants in a well-directed manner, it is necessary to set the width of the spray as exactly as possible and to aim the flow of drops as exactly as possible toward the surface.

A device for spraying a liquid in accordance with the species is known from U.S. Pat. No. 2,545,489. The rotating surface is partially enclosed in a housing and keeps an opening free over a part of the circumference. It has a reservoir and a flow path for collecting drops which were retained, in whose circulation a pump is provided for reuniting the collected liquid with the inflowing liquid.

This pump which returns the collected liquid is embodied as a housing revolving in the shape of a truncated cone which, driven by a gear wheel, rotates at approximately 1/10 of the rpm of the rotating surface. A second hub, which is inclined in respect to the axis of circulation of the rotating surface, is provided for this purpose, as well as a reduction gear with gear wheels which reduces the rpm of the shaft correspondingly. Finally, this device has a metering device which is embodied in a very complicated manner, which again provides the rotating surfaces with the inflowing liquid and the returned liquid partially separated by means of two valve disks.

The British document GB 2 164 270 shows a device wherein the pump is embodied as an axial pump for returning the liquid.

SUMMARY OF THE INVENTION

It is the object of the invention to recite a segment rotary nozzle which can be manufactured with reduced expense and further than that has a longer life expectancy.

This object is attained in accordance with a device of the species in that a conveying surface of a pump, preferably a friction pump, is disposed coaxially with the axis of rotation of the rotating surface. The liquid is returned to the rotating surface in a particularly cost-effective and maintenance-free manner by means of this step. Complicated gears can be omitted.

Because the rotating surface and the conveying surface are embodied as parts of a single rotating part, the pump can be manufactured particularly advantageously.

It is achieved by the step of the rotating surface having an axis of rotation which is inclined at an angle in respect to the horizontal that gravity makes the return of the liquid in the housing easier.

If the opening is embodied to be adjustable it is possible, for example, to also adapt the directed stream exiting through the opening to the desired spraying width by changing the opening sector. If the position of the opening is changed it is possible to spray upward, for example.

So that the caught drops can be better collected it is advantageous if the housing has bars on the inside for guiding the caught liquid.

The aspiration of the collected liquid at the termination of the spraying work is made easier in that a metering pump for supplying the liquid is associated with the device, whose conveying direction is embodied to be reversible. If further than that it has a line for supplying liquid which is disposed to terminate in the reservoir, the metering pump provided can in this case also perform the aspiration by reversing the direction of rotation.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

The invention will be explained in the drawings, and further advantageous details can be taken from the drawings.

In detail, the drawings show in.

DESCRIPTION OF THE PREFERRED EMBODIMENTS

Figure 1:
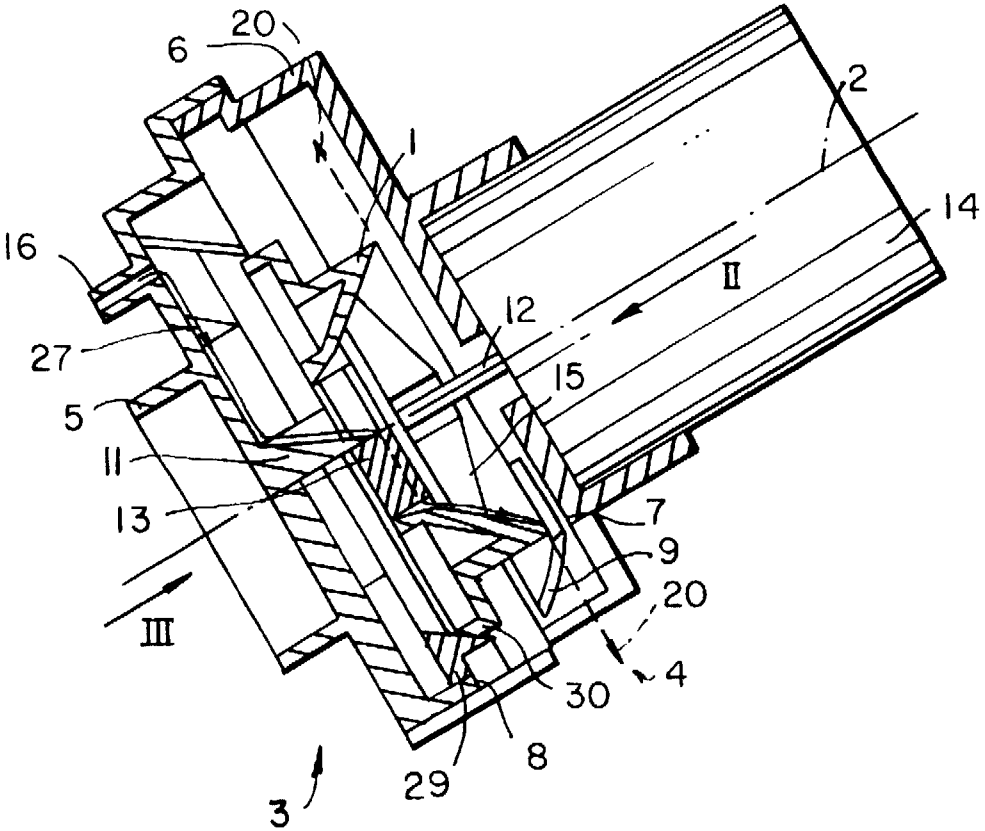
FIG. 1, a vertical section through the nozzle in the operational position.

A centrifugal wheel rotating around an axis 2 is identified by 1 in FIG. 1. It has an outer edge in the form of a rotating surface from which drops are flung away. The centrifugal wheel is enclosed by a housing 3. An opening 4 in the housing extends over a partial circumference of the centrifugal wheel.

The housing 3 essentially consists of the nozzle body 5 and the cover 6.

Figure 3:
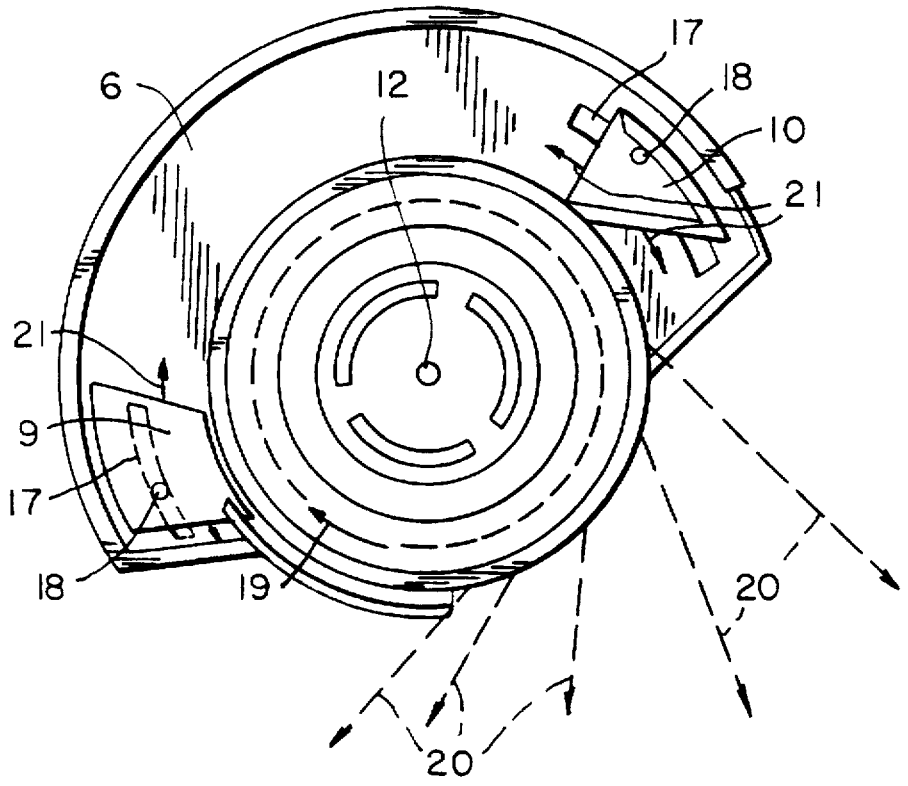

Segment aprons 9 and 10 (FIG. 3), which are also displaceable around the axis 2 along two arc-shaped adjustment openings 17 (FIG. 3), are disposed in the lateral edge area inside the opening 4 for the purpose of spray width adjustment. Thus the opening 4 can be adjusted by displacing the segment aprons 9 and 10 (FIG. 3). The spraying width can be affected by this. If, for example, the opening is displaced upward by changing the cover 6, it is also possible to spray against the direction of gravity. It is important that the reservoir 29 remains on the bottom.

The pump disk 30 is formed coaxially on the centrifugal disk and is thereby fixedly connected with the centrifugal disk. The drive shaft 12 is a part of a suitable motor 14.

The centrifugal wheel 1 and the pump disk 30 formed on it are fixedly connected with the drive shaft 4 by means of strips 15.

Finally, a feed opening 16 is provided, through which liquid to be sprayed is guided into the housing 3 formed by the nozzle body 5 and the cover 6. In this chamber the pump disk 30 rotates in the direction of the arrow 19 (FIG. 3).

Figure 2:
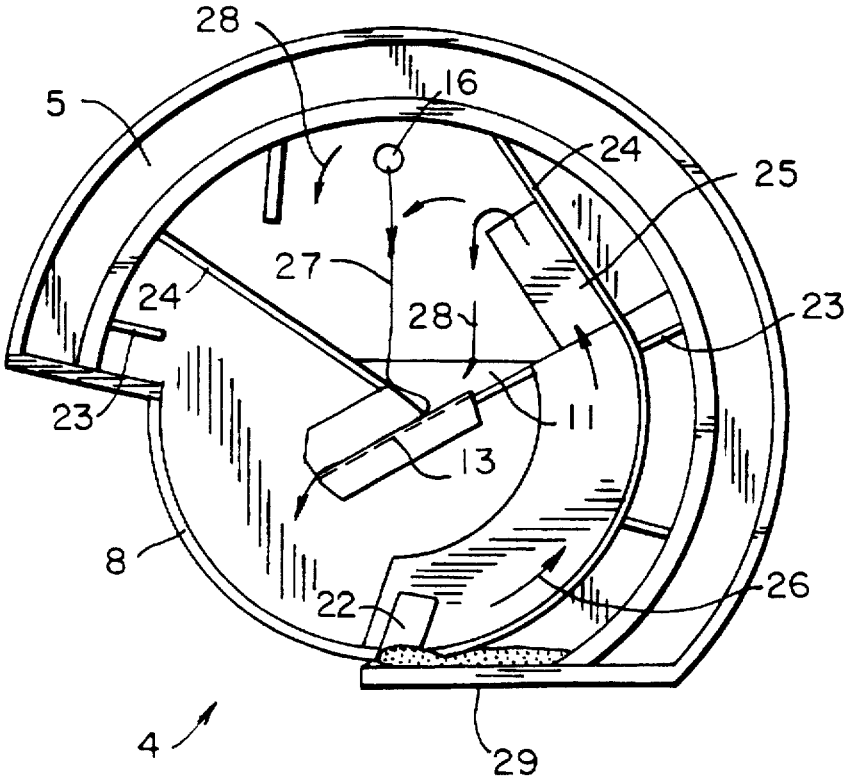
FIG. 2, a top view of the nozzle housing in accordance with the arrow direction II in FIG. 1, FIG. 3, a top view of the nozzle cover with the centrifugal disk in accordance with the arrow direction III in FIG. 1, FIG. 4, the flow chart of a spraying device, and FIG. 5, an exploded view of the device in accordance with the invention.

A view of the interior of the nozzle body 5 with feeding of the nozzle in accordance with arrow direction II in FIG. 1 is represented in FIG. 2. As in the remaining figures, like elements are provided with the same reference numerals. Bars 23, 24 inside the nozzle body 5 are used for guiding the liquid.

Arrows 28 are additionally represented in FIG. 2 for explaining the flow path of a liquid to be sprayed. The liquid is supplied supplied via a line system through the feed line 16 to the inner recess of the nozzle body 5.

The liquid flowing in through the opening 16 is guided in the direction of the flow path 27 to the half-open beak-like embodied groove 13 arranged in the center of the nozzle body 5, which is formed on the bars 24. The liquid is then provided from the groove 13 to the inside of the centrifugal disk 1.

Fed-in liquid is flung off the outer edge of the centrifugal wheel 1 by the high speed. Individual droplet paths are indicated by the arrows 20 (FIG. 3) drawn in dotted lines. It can be seen particularly clearly in this view how the spraying width of the rotating nozzles can be changed by displacing the segment aprons 10 and 9 around the axis 2 in one of the directions of the arrows 21. The segment aprons 9 and 10 can be fixed in place by means of arresting screws 18 after they have been set.

The flung-off liquid is caught over a greater part of the circumference by the cylindrical interior surface of the cover 6 (FIG. 3). This portion of the liquid is diverted by the surface 7 of the cover 6 and flows, following gravity, into the lower housing part of the nozzle body 5, which is formed by the cylindrical surface 8 and is used as the reservoir 29. The liquid collected in the reservoir 29 enters the area of the pump disk 30 through the opening 22, where it is picked up by the pump disk 30 to be again conveyed via the ramp 25 along the flow path indicated by the arrow 26/28 into the upper area in order to be supplied to the centrifugal disk 1 via the incline 11, groove 13, together with the inflowing liquid.

Figure 4:
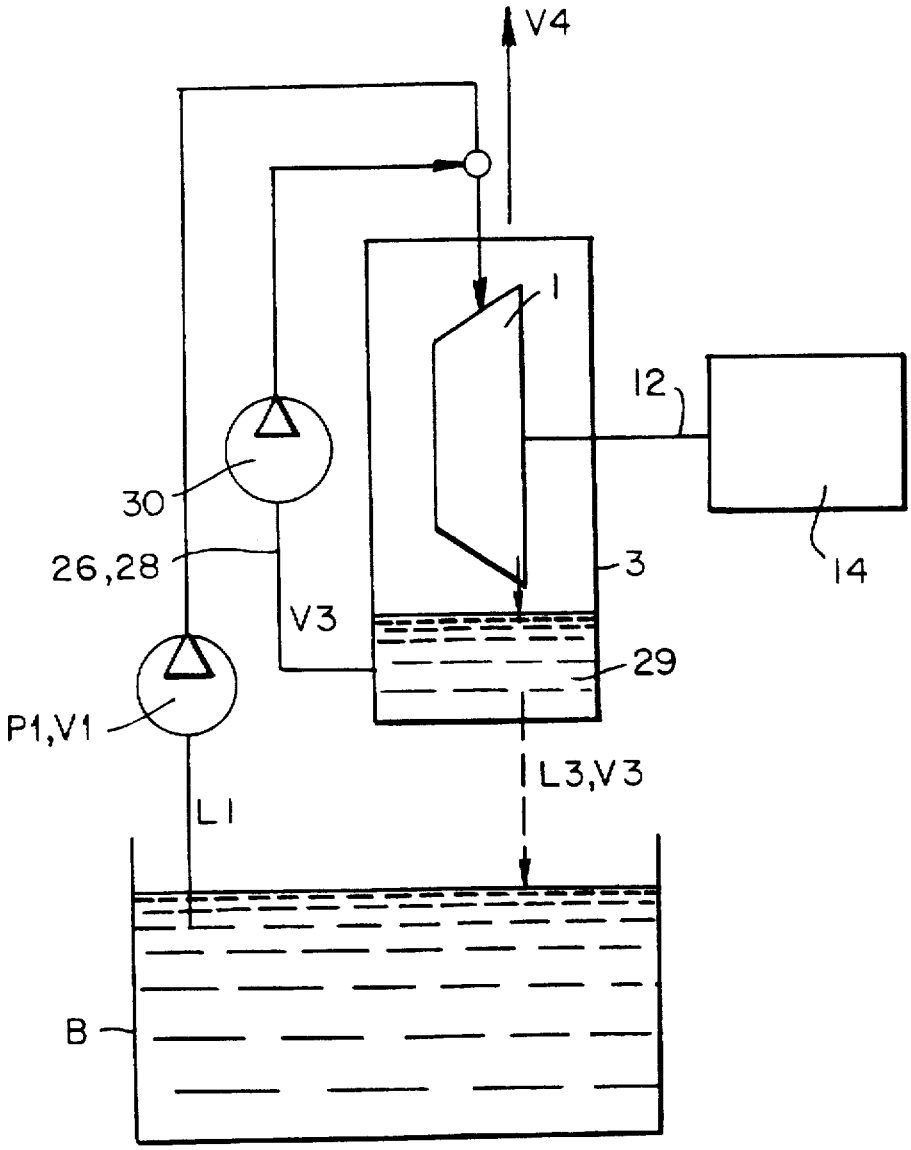

FIG. 4 schematically shows the mode of functioning of the device. A volume flow V1 is aspirated from a container B by means of the reversible metering pump P1 from the line L1 and is conveyed to the centrifugal wheel 1. From there a partial volume V4 of the formed drops is flung off. The rest is retained in the housing 3 and collected in the reservoir 29. The propulsion of the centrifugal disk 1 takes place by means of the motor 14 via the drive shaft 12. The volume flow V3 is conveyed from the reservoir 29 by means of the pump disk 30 and united with the volume flow V1 and together with it again provided to the centrifugal wheel 1. The alternate line path L3, represented in broken lines, is also possible in place of the flow path 26, 28, which, however, requires a different behavior of the device, as described.

Figure 5:
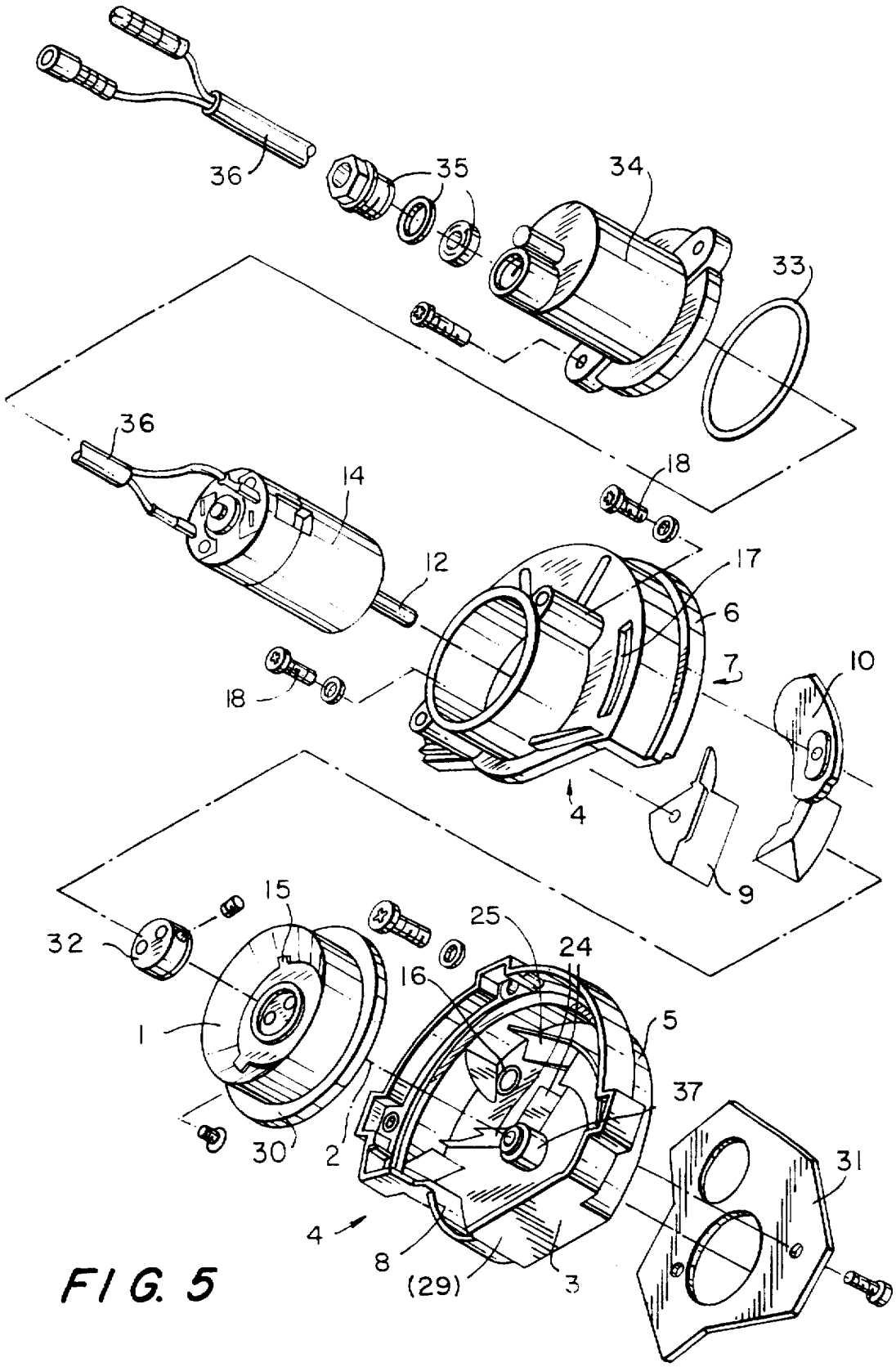

FIG. 5 shows an exploded representation of the device. Like elements are indicated therein by the same reference numerals. The axis 2, shown in dash-dotted representation, indicates the coaxial association of the individual parts.

Accordingly, the nozzle body 5 is mounted on the mounting plate 31. Furthermore, following insertion of the motor 14 into the cover 6 and slipping on the motor housing 34, they are combined into a further assembly group. The shaft 12 of the motor 14 is than fastened to the centrifugal disk 1 by means of the coupling 32.

The seal 33 in the mounting gap between the motor housing 34 and the cover 6, as well as the compressed screw connection 35 for leading the cable 36 in, protect the motor from environmental effects. Following the mounting of the segment aprons 9 and 10, the sub-assembly of the cover 6 and the sub-assembly of the nozzle body 5 are screwed together.

In FIG. 5 the transfer of the liquid from the cover 5 to the centrifugal wheel 1 takes place by means of a transfer pipe 37, in whose center a tapered cone, not shown, of the centrifugal wheel 1 rotates. This solution fulfills the same function as the groove 13, but has advantages in case of liquids of high viscosity. In addition, the effect of the angular position is reduced. It will be understood that each of the elements described above, or two or more together, may also find a useful application in other types of constructions differing from the types described above.

While the invention has been illustrated and described as embodied in a segment rotary nozzle, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for spraying a liquid, comprising a rotating surface having an axis of rotation; a housing partially enclosing said rotating surface and having a circumference with an opening leaving a part of said circumference free; means for collecting retained drops, said collecting means including a reservoir; a pump combining a collected liquid and flowing liquid, said pump having a conveying surface which is located coaxially with said axis of rotation of said rotating surface; a single rotating element, said rotating surface and said conveying surface being parts of said single rotating element, said axis of rotation of said rotating surface being inclined at an angle with respect to a horizontal; and a metering pump for supplying liquid, said metering pump having a reversible conveying direction.

2. A device as defined in claim 1, wherein said pump is a friction pump.

3. A device as defined in claim 1, wherein said opening of said housing is adjustable.

4. A device as defined in claim 1, wherein said opening of said housing has a position which is adjustable.

5. A device as defined in claim 1, wherein said housing has an inner side and is provided on said inner side with bars for guiding a caught liquid.

* * * * *